United States Patent [19]

Ennis

[11] 4,128,474

[45] Dec. 5, 1978

[54] PROCESS FOR CLEANING AND DEWATERING FINE COAL

[75] Inventor: Robert E. Ennis, West Simsbury, Conn.

[73] Assignee: Linatex Corporation of America, Stafford Springs, Conn.

[21] Appl. No.: 780,978

[22] Filed: Mar. 24, 1977

[51] Int. Cl.[2] ..... B03B 5/48

[52] U.S. Cl. ..... 209/2

[58] Field of Search ..... 209/2, 13, 17, 18, 459, 209/211

[56] References Cited

U.S. PATENT DOCUMENTS

| | | | |
|---|---|---|---|
| 2,431,560 | 11/1947 | Humphreys | 209/211 |
| 3,923,210 | 12/1975 | Jackson | 222/529 |
| 3,926,787 | 12/1975 | Gay | 209/211 |
| 3,929,642 | 12/1975 | Ennis et al. | 209/256 |
| 3,970,549 | 7/1976 | Ennis et al. | 209/341 |

OTHER PUBLICATIONS

Thompson et al.; "The Humphreys Spiral—Some Present and Potential Applications"; Aug., 1950; Engineering and Mining Journal; pp. 87–89.

*Primary Examiner*—William A. Cuchlinski, Jr.
*Assistant Examiner*—Jon E. Hokanson
*Attorney, Agent, or Firm*—Prutzman, Kalb, Chilton & Alix

[57] ABSTRACT

A wet mechanical process is described for cleaning, upgrading and dewatering fine coal. The process provides for forming an aqueous feed slurry of fine coal and its associated contaminant particles wherein all particles have a particle portion size of less than about 6 mm. ranging to zero. The feed slurry is separated into coal slurry and refuse slurry portions in a spiral gravity concentrator by removing contaminants having a particle size greater than about 0.15 mm. The concentrated coal slurry is then fed to a hydrocyclone separator where all of the ultra-fine silt material having a particle size of less than 0.15 mm. is removed and the coal particle fraction 6 mm. to 0.15 mm. is accumulated and thoroughly dewatered.

12 Claims, 3 Drawing Figures

FIG. 1

CRUSHED RAW COAL
10
14
12
16
HEAVY MEDIA SEPARATOR
24
26
28
30

20
FEED DISTRIBUTOR
18
22
22
22

34
COAL COLLECTOR
32
36
WASTE
44
38
40

42
46
CLEAN COAL
48
48

PROCESS FOR CLEANING AND DEWATERING FINE COAL

BACKGROUND AND SUMMARY OF THE INVENTION

The present invention relates to a process for cleaning coal of fine particle size. More particularly, it is concerned with a new and improved process for mechanically removing unwanted contaminant particles from fine coal and dewatering the cleaned coal sufficiently to permit stockpiling.

In the cleaning, upgrading or cencentration of coal for commercial use as fuel and the like, it is necessary to remove rock and other contaminant particles that are mined with the coal. The rock and other impurities are generally unavoidable in thin-seam mining where the coal stratum is of limited thickness. In such cases it is very difficult to remove the coal without also taking minor amounts of host rock which encloses the coal seam. As will be appreciated, the least possible amount of rock is preferred in order to provide the highest possible quantity of combustible material and least amount of unwanted residue. Another typical impurity is sulfur in the form of pyrite (iron sulfide). It undesirably generates harmful sulfur-containing gases which decrease the efficiency of combustion and provide sulfur oxide compounds contributing to unwanted air pollution levels.

The treatment of coal for the purpose of removing these impurities conventionally involves the preliminary step of classifying the crushed coal into two size fractions. The large or coarse fraction conventionally exhibits a size range of from about 3 inches to about ¼ inch, while the second or "fine" fraction comprises all of the mined material smaller than ¼ inch. This classification is readily achieved by passing the crushed coal across a sizing screen deck. A plurality of water sprays are used to assist in the separation of the fine coal from the coarser material.

The coarse coal can be treated to remove the rock and impurities of high specific gravity by means of a heavy media separation technique. In that process the coarse coal fraction is placed in a tank filled with a liquid having a specific gravity slightly higher than coal. The coal tends to float on the surface of the liquid while the impurities that exhibit a substantially higher specific gravity sink to the bottom of the tank and are removed separately, as waste material. The coarse coal is then easily dewatered on conventional dewatering screens prior to stockpiling.

Unfortunately, the heavy media technique used for coarse coal is not effective for cleaning the fine materials, that is, those having a particle size of about ¼ inch and less. An appreciable amount of the small impurity particles possess insufficient mass to sink within the dense liquid media, and become permanently suspended within the liquid, thereby preventing their separating from the coal particles of equal size.

Various chemical and mechanical processes have been used for cleaning the fine coal material. These have included chemical flotation, shaking tables, heavy media cyclones, water only cyclones and air separation. The cleaned material is then centrifuged to dewater the material for storage. Among these techniques, the most commonly used system has been the use of shaking table separators combined with dewatering centrifuges. The vibratory motion of the shaking tables have the disadvantages of poor efficiency below 48-mesh and high energy consumption. The shaking tables also require large plant floor space per ton processed and have a relatively high initial cost. The prior systems also suffer from the high maintenance cost of centrifugal drying apparatus and the tendency to grind the particles during the centrifuging operation, resulting in an ultrafine material, much of which is suspended within and discarded with the process waste effluent.

Accordingly, it is an object of the present invention to provide a new and improved process for the wet concentration and dewatering of fine coal. Included in this object is the provision for a new and improved wet mchanical method that utilizes a three-step technique for sequentially and selectively removing impurity fractions, and efficiently dewatering the concentrated fine coal product to an extent sufficient to permit stockpiling, shipment and sale.

Another object of the present invention is to provide a wet mechanical process for the concentration of fine coal that provides improved coal recovery.

Yet another object of the present invention is to provide a process of the type described that achieves beneficiation of fine coal at significantly lower investment cost in both plant and equipment and substantially lower maintenance cost and power consumption.

Still another object of the present invention is to provide a mechanical process for the wet concentration of fine coal that includes the benefits inherent in the utilization of a gravity flow centrifugal separation. Coupled with this is the utilization of a high efficiency dewatering technique that provides for the complete removal of substantially all of the free excess water, thereby delivering a cleaned and dewatered coal product to a stockpile location without the need for subsequent dewatering operations.

A further object of the present invention is to provide a process that concentrates and fractionates the raw feed stock to clean and upgrade the fine coal followed by dewatering without loss of the very fine coal particles. Included in this object is the provision for a process of the type described resulting in a deslimed fine coal fraction substantially free of ultra-fine particles while obviating losses resulting from the grinding of particles in a centrifugal drying operation.

Other objects will be in part obvious and in part pointed out more in detail hereinafter.

These and related objects are accomplished in accordance with the present invention by providing a process for cleaning fine coal that comprises the steps of forming a water slurry of fine coal and its associated contaminant particles wherein all particles have a particle size of less than about 10 mm.; feeding the slurry to a spiral gravity concentrator so that as the slurry flows downwardly along the spiral, the heavier contaminants having a particle size greater than about 0.1 mm. concentrated in a band separate from the remainder of the slurry for subsequent removal and discarding; feeding the remainder of the coal slurry to a hydrocyclone separator and regulating the discharge from the descending vortex thereof to provide controlled accumulation at the descending vortex of a coal particle fraction having a size greater than 0.1 mm; retaining in suspension and discarding all of the ultra-fine silt material reporting to the ascending vortex of the hydrocyclone and dewatering the collected coal fraction treated in both the spiral concentrator and hydrocyclone separator sufficiently to permit stockpiling of the cleaned coal.

A better understanding of this invention will be obtained from the following detailed description and the accompanying drawing wherein the several steps of the process and the relation of one or more of such steps with respect to each of the others are described together with the product thereof and the features, properties, and relation of elements described and exemplified herein.

DESCRIPTION OF A PREFERRED EMBODIMENT

Figures 1, 2, 3:
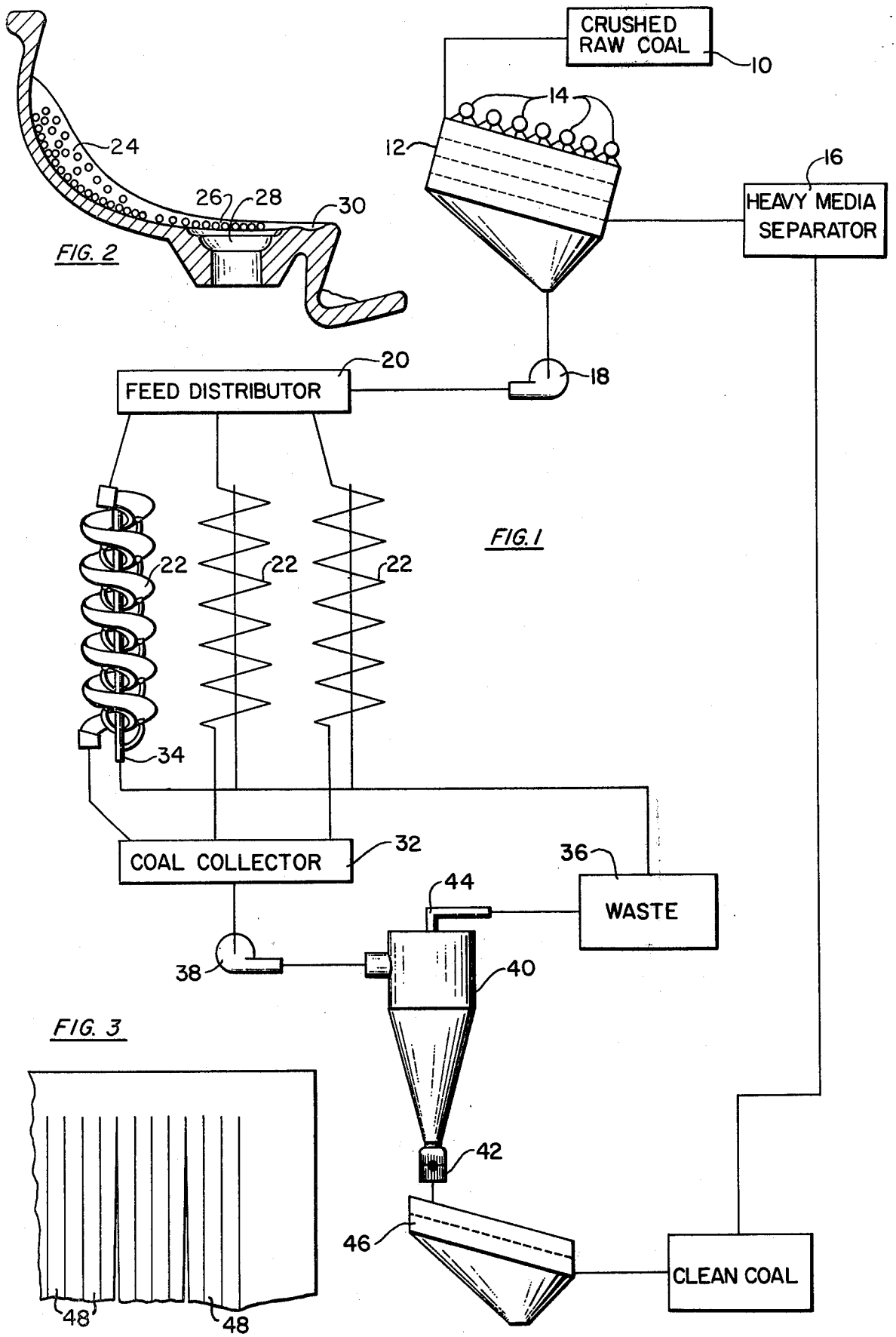
FIG. 1 is a flow chart schematically depicting a preferred embodiment of the process of the present invention.
FIG. 2 is an enlarged sectional view of the spiral gravity concentrator.
FIG. 3 is a top view of a portion of the dewatering screen panel of FIG. 1 illustratively depicting the independent and random motion of the elements in the panel during the screening operation.

As mentioned hereinbefore, crushed raw coal is initially classified into a coarse segment and a fine segment prior to the cleaning operation. Typically, this classification is accomplished by a water spray screen technique whereby the fine particles, i.e., those having a particle size less than about 10 mm. and preferably less than about 6 mm., are separated from the coarse material by the action of a water spray as the material flows across a vibratory sizing screen. Techniques of this type are well known, as reported in the textbook "Coal Preparation" By Joseph W. Leonard and David R. Mitchell (The Am. Inst. of Mining, Metallurgical and Petroleum Engineers, Inc., New York 1968). As shown in the drawing, the crushed raw coal 10 is fed to a multi-deck sizing screen 12 provided with a series of water-sprays 14 which help carry the fine coal particles through the screen assembly. The coarse coal is fed to a heavy media separator 16 for removal of the high specific gravity impurities therefrom.

As mentioned, the present invention is concerned with a technique or process for mechanically upgrading or concentrating the fine coal resulting from the classification operation. As will be appreciated, the fine coal could be derived from techniques other than the classifying separation mentioned and illustrated herein. For example, stockpiles of previously discarded fine material could be utilized as the source of the fine coal. In the past fine material of this type has been discarded due to the adverse economics associated with the cleaning operation. However, the present invention provides an economical and efficient method for concentrating such previously discarded material.

The fine coal resulting from the said sizing screen operation or derived from any other source is used in the process of the present invention in the form of a dilute aqueous slurry. Thus the coal may be used directly as received from the wet sizing screen operation or may be deliberately formed into the requisite dilute slurry for use within the process. As will be appreciated, the solids content of the initial fine coal slurry may vary substantially. However, typically, the solids content is less than 50 percent by weight and conventionally is between 25 and 35 percent by weight solids. This dilute water slurry of the fine coal particles and its associated comtaminants, such as rock, slime, clay, silt, and pyrite sulfur as well as other impurities are, according to the present invention, subjected to a three-step operation that includes two wet concentrating and fractionating operations and a final dewatering operation. It is an advantage of the present invention that the two concentrating and fractionating operations can be interchanged in sequence. However, as shown in the drawing, the preferred sequence employs a spiral gravity concentration step as the first separation operation while a hydrocyclone fractionation is performed on the cleaned concentrate from the spiral gravity operation. The advantage of utilizing the preferred step sequence is that the cleaned product delivered from the hydrocyclone has a substantially higher solids content (reduced water content) and thus requires less dewatering than the product resulting from the spiral concentrator operation.

As mentioned, the fine particulate coal and its associated contaminants forming the feed material have a particle size of less than 10 mm. and preferably less than 6 mm. This material is first formed into a dilute water slurry. The concentration of the slurry is dictated by both its ability to be conveyed through the process and the requirements of the separating operations. Accordingly, the concentration of the solids within the feed slurry can vary substantially depending on the characteristics of the initially fed material. Usually the concentration is less than 50 percent with about 30 percent solids frequently used to facilitate movement of the slurry to and through the initial concentrating step of the process. This can be achieved in a continuous operation by testing the feed material and adjusting the flow from the watersprays 14 associated with the sizing screen 12. As shown the fine coal slurry from the screen 12 is collected in a sump and fed by a pump 18 to a spiral feed distributor 20, which evenly divides and delivers the slurry through suitable conduits to the numerous spiral gravity concentrators 22 in the system.

The spiral gravity concentrators or separators 22 utilized by the process of the present invention are similar to those that have been known and used extensively in the iron ore industry. As stated in the conclusion of the Bureau of Mines Report of Investigations 1976 (RI 8152) J. E. Zeilinger and A. W. Deurbrouck entitled "Physical Desulfurization of Fine Size Coals by a Spiral Concentrator", "The spiral, although not generally considerd as a coal-washing device, deserves further investigation because of" its apparent economic advantages. The spiral gravity separators are of the type described in Humphreys U.S. Pat. No. 2,431,560 entitled "Helical Chute Concentrator", that is, a spiral conduit of modified semi-circular cross section having five or six full turns and one or more spaced ports per turn located at the lowest point in the radial cross section of the conduit.

In accodance with the theory of operation of the spiral gravity concentrator, a slurry is fed to the top of the spiral channel. As the water flows down the channel, each solid particle within the slurry will be subjected to a centrifugal force tangential to the channel. This centrifugal force will drive most of the water toward the outer rim of the spiral until the flowing stream reaches an equilibrium between centrifugal force outwardly and gravitational force downwardly. The velocity of the spiral stream decreases with depth from a maximum which is just below the surface of the water to approximately zero velocity at the point of contact with the channel. The bottom layer of water, retarded by friction, has a lower centrifugal force component and will flow sideways or radially inwardly along the bottom of the channel toward the low point of the curved channel carrying with it the heavier particles. Simultaneously with this bottom flow of water radially inwardly is the upper water flow outwardly. Thus, there are several combined radial as well as gravitational forces that tend to sweep, sort and concentrate the particles suspended within the stream.

In accordance with the present invention, the fine coal slurry is fed to the top of the spiral conduit of the concentrator 22 and as it flows downwardly along the spiral, the heavier rock and pyrite particles concentrate or collect at the lowest point of the stream channel under the influence of the dynamics of the system. The coal particles in the slurry, being lighter than or of a lower specific gravity than the associated contaminants are rapidly thrown to the radially outer and upper flow zone of the spiral where the water of greatest depth tends to accumulate. This upper flow zone is designated by the numeral 24 in FIG. 2. The coal remains within outer zone 24 during its travel down the spiral path of the separator. The rock, slate, and pyrite respond differently. Although they are initially thrown radially outwardly by the centrifugal force of the spiral channel, they tend to settle to the bottom of the liquid slurry in the outer zone 24 and are swept radially inwardly by the water flow so as to settle downwardly and inwardly within the spiral wash channel and form a concentrated band near the channel's cross sectional low point. The concentrated impurity band is designated by the numeral 26 in FIG. 2. As mentioned, adjustable ports, such as port 28, are located at the lowest point in the cross section of the conduit and in the approximate area where the heavier particles are concentrated. In the operation of the spiral, additional wash water is added at the radially inner edge 30 of the conduit and tends to flow outwardly across the heavy particle band 26 so as to sweepably cleanse the band and further remove any lighter coal particles that may have been trapped therein. The adjustability of the ports 28 permits control over the width of the heavy particle band removed at each port. Typically each full turn of the spiral will contain from one to three such ports which can be adjustably positioned to accept portions of the concentrated heavy particle band located at slightly different radial locations across the cross section of the conduit.

All of the rock, slate, pyrite, and other impurities within the fine coal do not concentrate within the impurity band 26 of the spiral gravity separator 22. In particular, the ultra-fine particles, i.e., those particles having a size below about 100 mesh (0.15 mm.) do not have sufficient mass to overcome the centrifugal force within the spiral separator, and consequently remain with the coal in the upper flow zone 24 of the spiral. As mentioned, the upper size of these extremely fine particles is in the neighborhood of 100 mesh and will flow as part of the coal stream rather than settle out with the concentrated impurity band. In this connection, it should also be noted that coal particles are of generally cubic configuration, while the impurities and particularly the shale and slate tend to be of a planar or flat configuration. The flat material tends to report to the impurity band 26 in a finer particle size than the less planar material so that it is removed within the concentrated impurity band of the spiral separator. Thus, as will be appreciated, the rock, slate, pyrite, and other impurities having particle size greater than about 0.1 mm. and usually greater than 0.15 mm. report to the concentrated impurity band 26 and are removed from the coal slurry while all of the coal and the very fine impurities such as silt or the like are carried with the upper flow zone 24 and are collected in suitable collecting flumes 32 (launders) for delivery to the next stage of the coal processing operation.

As schematically illustrated in FIG. 1 of the drawing, the heavy refuse or contaminants concentrated in the spiral gravity separators 22 and removed at the discharge ports 28 can conveniently be fed to a coaxially extending refuse collecting pipe 34 for subsequent discharge to a waste area 36. As will be appreciated, the process of the present invention is not limited to a specific type or configuration for the spiral, although the spiral described hereinbefore has been found to operate effectively and efficiently. For example, configurations such as two counter rotating or intertwined spirals may be employed in a single frame or the number of turns in each spiral may be increased or may be in a different vertical pitch. In some cases two or more successive stages of spiral washing may be employed with a portion of the refuse product being recirculated from one or more of the stages.

The coal slurry collected at 32 after passage through the spiral concentrators 22 still contains the very fine or ultra-fine rock, silt, clay, and the like, having a particle size of less than about 100 mesh. This concentrated slurry is fed to the second stage of the mechanical cleaning operation of the present invention. This partially cleaned or concentrated material typically flows by gravity to a collecting sump from which it is delivered by a pump 38 to the inlet orifice of a hydrocyclone separator such as the hydrocyclone 40 which has been modified to include an underflow regulator 42 to control and regulate the underflow discharge emitting therefrom. This second-stage fractionating operation achieves desliming and a partial dewatering of the fine coal particles by concentrating or accumulating all but the very fine coal particles, i.e., those having a size greater than 0.1 mm., at the underflow of the hydrocyclone. Although it is believed that conventional hydrocyclones could be used to achieve this secondary cleaning function, it has been found that unexpectedly improved fractionation is achieved using hydrocyclones fitted with an underflow discharge regulator of the type described in Jackson U.S. Pat. No. 3,923,210. Such assemblies produce excellent coal fraction separation and have the beneficial effects of an automatic and controlled discharge at the underflow of the hydrocyclone to optimize rejection of unwanted silts and maximize the solids content of the slurry passing to the subsequent dewatering operation.

As shown, the underflow regulator 42 controllably closes the underflow orifice at the bottom of the hydrocyclone and does so in a manner which permits the accumulation of coal particles having a particle size greater than about 0.1 mm. The accumulated coal provides a reservoir of small particles at the underflow port of the separator, and the discharge of the accumulated solid material is regulated by controlling the vacuum within the hydrocyclone in the manner described in greater detail in the aforementioned Jackson patent. All of the solid silt material and slime having a particle size less than about 0.1 mm. will remain suspended within the water and will report to the ascending vortex finder 44 of the hydrocyclone for dicharge through the overflow conduit to the waste area.

Typically, the partially cleaned coal slurry is fed to the hydrocyclone separator with additional quantities of water so that the solids content of the partially cleaned slurry is typically at least equal to or less than the solids content of the slurry originally fed to the spiral gravity concentrators 22. The slurry typically enters the hydrocyclone tangentially at the feed box under a pressure head, for example, at a pressure of about 5 to 10 psi. The rotation imparted to the slurry and the additionally fed water by its entry into the feed box causes the coal particles having a size greater than about 0.1 mm. and preferably greater than 100 mesh to be thrown outwardly by centrifugal force against the outer walls of the hydrocyclone. The coal particles under the influence of the centrifugal force and the influence of gravity pass downwardly along the conical sides toward the underflow orifice. The underflow regulator 42 prevents passage of the coal particles outwardly from the hydrocyclone. As mentioned, the vortex finder and overflow 44 acts as a suction tube which creates a negative pressure or upward suction force within the separator. This force maintains the underflow regulator 42 at the bottom of the separator in a closed condition. When sufficient clean coal solid particles have collected, the regulator is opened by the pressure of the solid coal particles and discharges those particles at a substantially higher solid content than would be achieved with a conventional hydrocyclone which typically discharges a coal slurry at about only 60 percent solids. More importantly the closed underflow regulator provides for increased water flow through the vortex finder and therefore increased removal of unwanted silt contaminants that remain suspended within the water. Generally the solids content of the underflow discharge from the hydrocyclone is in the range of about 65 to 70 percent, with 68 percent solids content being an average or typical value. As will be appreciated, however, the syphon forces in the overflow can be adjusted and controlled so as to regulate the extent of accumulation of the solid coal particles prior to discharge through the underflow regulator. Advantageously, once this syphon force control has been properly adjusted, no further readjustment is necessary.

As will be appreciated, substantially all of the water, including the very fine or ultra-fine particles of silt, clay, slime and other solid material having a particle size of less than 0.1 mm. will report to the ascending vortex finder 44, will pass upwardly into the overflow pipe and will be directed to the appropriate waste accumulation station. The coal fraction reporting to the underflow regulator is now free or substantially free of all of the ultra-fine silt particles. Additionally, a large quantity of the free water associated with the coal has been separated from the cleaned and concentrated coal fraction so that the water content of the coal is now at less than 50 percent by weight and typically only about 30 percent by weight.

The clean, particulate coal fraction discharged from the underflow regulator of the hydrocyclone has a particle size range of about 0.1 to 10 mm. and preferably about 0.15 to 6 mm. This coal fraction and the surface water associated therewith is fed by gravity flow to a vibratory dewatering screen such as the screen 46 of FIG. 1. Preferably the screen 46 is a panel deck assembly of the type described in Ennis et al. U.S. Pat. No. 3,970,549. The vibratory dewatering screen of that patent oscillates at a predetermined frequency and provides a random array of independently pulsating dewatering diaphragm elements 48, as shown in FIG. 3, that rapidly and efficiently remove the water from slurries containing solids of fine particle size. As the fine coal fraction flows along the dewatering screen the pulsating motion of the diaphragm elements effectively draws the remainder of the substantially free water associated with the coal through the deck while simultaneously causing the fine particulate material to form a coherent mass without loss of the fine particulate material. Where desired, the deck may include a vacuum assist water removal section of the type described in Ennis et al., U.S. Pat. No. 3,929,642. The resultant fine coal product will have a solids content of about 70 to 80 percent and typicaly about 75 percent and can, if desired be combined, with the clean coarse coal prior to stockpiling.

As a result of the foregoing cleaning and dewatering process, the fine coal fraction shows substantial beneficiation with an appreciable reduction in both ash and sulfur content. Exemplary of the reduction in ash and sulfur resulting from this process are the data set forth in the following table:

TABLE I

| | Fine Coal Feed | | Clean Coal Product | |
|---|---|---|---|---|
| Sample Code | % Ash | % Sulfur | % Ash | % Sulfur |
| 1 | 30.82 | 0.55 | 8.97 | 0.43 |
| 2 | 18.73 | 0.62 | 9.39 | 0.50 |
| 3 | 32.60 | 0.60 | 10.21 | 0.58 |
| 4 | 38.67 | 0.45 | 12.00 | 0.37 |
| 5 | 15.81 | 0.63 | 6.32 | 0.63 |
| 6 | 14.55 | 3.65 | 8.36 | 1.71 |
| 7 | 22.00 | 1.30 | 7.12 | 0.70 |

All samples had a particle size in the initial feed of less than ¼ inch (6 mm.) and were fed to spiral gravity separators having six full turns of approximately 24 inches in diameter with a 13 inch pitch per turn and an approximate total height of about 6 feet. The water slurry had a concentration of approximately 30 percent solids by weight. The hydrocyclone had a feed box diameter of about 30 inches and was fitted with an underflow regulator. As will be noted from the table, the ash content is typically reduced to about 30 to 50 percent of its original level, while the sulfur content shows a reduction to a level of about 45 percent of its original content for Sample 6 with other samples varying depending on the amount of sulfur present in the original feed material. It will be appreciated that the characteristic presence of inherent ash and sulfur in virtually all coal material makes complete removal of these contaminants impossible. The inherent ash for the samples tested ranged from 4 to 8 percent. In all instances, a substantial beneficiation is evident from the ash and sulfur analyses of the clean coal product relative to its corresponding feed material.

As will be apparent to persons skilled in the art, various modifications, adaptations, and variations of the foregoing specific disclosure can be made without departing from the teachings of the present invention.

I claim:

1. A process for the wet concentration of fine coal comprising the steps of providing an aqueous feed slurry of coal and associated contaminate particles, the solids in said feed slurry having a particle size of less than about 10 mm.; feeding at least the portion of said slurry having contaminate particles greater than 0.1 mm. through a spiral gravity concentrator so that as the slurry flows along the spiral under gravity the heavier contaminates having a particle size greater than about 0.1 mm. concentrate in a band separate from at least the portion of the coal slurry having contaminate particles greater than 0.1 mm., and (c); feeding to a hydrocyclone separator at least the portion of the coal slurry containing the coal and the associated contaminate particles of less than 0.1 mm., said hydrocyclone having ascending vortex finder and an underflow discharge port; regulating the discharge from the discharge port to provide controlled accumulation at said port of a coal particle fraction having a particle size greater than about 0.1 mm. while discarding substantially all contaminate particles of less than 0.1 mm. reporting to the ascending vortex finder, discharging the coal fraction accumulated at the discharge port at a substantially higher solids concentration than the slurry entering said hydrocyclone separator and dewatering the coal fraction slurry treated in both said spiral and hydrocyclone separators sufficiently to permit stockpiling of the cleaned coal fraction.

2. The process of claim 1 wherein said feed slurry has a concentration of less than about 50 percent by weight solid particles and the cleaned coal fraction prior to dewatering has a concentration of greater than 50 percent by weight solid particles.

3. The process of claim 1 wherein the concentrated band of heavier contaminates is controllably removed from the spiral gravity concentrator separately of the coal slurry.

4. The process of claim 3 wherein said band of contaminates exhibit a particle size predominantly in the range of about 0.1 to 10 mm.

5. The process of claim 1 wherein the discharge of the coal fraction slurry through the underflow discharge port is automatically controlled by an underflow regulator, the coal particles in said slurry constituting more than 65 percent by weight of said discharged slurry.

6. The process of claim 1 wherein said dewatering includes the step of feeding the treated coal fraction slurry to a vibratory screen deck having diaphragm elements while vibrating said deck at a frequency and amplitude sufficient to effect limited pulsating motion of said diaphragm elements within the plane of the deck.

7. The process of claim 6 including the step of applying a vacuum to the underside of said deck to assist in the removal of water from said treated coal fraction slurry.

8. The process of claim 1 wherein the cleaned coal exhibits a particle size predominantly in the range of about 0.1 to 10 mm.

9. The process of claim 1 wherein the particle size of the feed material is less than about 6 mm.

10. The process of claim 1 wherein the feed slurry has a concentration of less than about 35 percent by weight solid particles and the clean coal is dewatered to a concentration of about 75 percent by weight solids.

11. The process of claim 1 wherein the coal slurry is fed first to the spiral concentrator and the resultant coal slurry free of heavier contaminates is subsequently fed to the hydrocyclone separator.

12. The process of claim 1 wherein the coal slurry is fed first to the hydrocyclone separator and the resultant coal slurry free of contaminate particles of less than 0.1 mm. is subsequently fed to the spiral concentrator.

* * * * *